US011598598B2

(12) United States Patent
Robinson

(10) Patent No.: US 11,598,598 B2
(45) **Date of Patent: *Mar. 7, 2023**

(54) TRIGGER GUARD ASSEMBLIES

(71) Applicant: WHG Properties, LLC, North Wales, PA (US)

(72) Inventor: Frank E. Robinson, Schwenksville, PA (US)

(73) Assignee: WHG Properties, LLC, North Wales, PA (US)

( * ) Notice: Subject to any disclaimer, the term of this patent is extended or adjusted under 35 U.S.C. 154(b) by 100 days.

This patent is subject to a terminal disclaimer.

(21) Appl. No.: 17/243,354

(22) Filed: Apr. 28, 2021

(65) Prior Publication Data

US 2021/0262749 A1 Aug. 26, 2021

Related U.S. Application Data

(63) Continuation of application No. 16/362,277, filed on Mar. 22, 2019, now Pat. No. 11,022,393.

(51) Int. Cl.
*F41A 19/11* (2006.01)

(52) U.S. Cl.
CPC ..... *F41A 19/11* (2013.01)

(58) Field of Classification Search
CPC ..... F41A 19/11
See application file for complete search history.

(56) References Cited

U.S. PATENT DOCUMENTS

| | | | | |
|---|---|---|---|---|
| 3,142,126 | A | 7/1964 | Rohm | |
| 3,187,454 | A | 6/1965 | Geber | |
| 4,468,876 | A | 9/1984 | Ghisoni | |
| 4,499,683 | A | 2/1985 | Savioli | |
| 7,076,902 | B2 | 7/2006 | Hengstenberg | |
| 7,726,060 | B1 | 6/2010 | Jones | |
| 7,786,397 | B2 | 8/2010 | Dick | |
| 8,984,794 | B1 | 3/2015 | Saur | |
| 9,003,685 | B1 | 4/2015 | Huang | |
| 9,217,618 | B1 | 12/2015 | Miller, III | |
| 10,571,210 | B2 | 2/2020 | Amodio | |
| 11,313,637 | B1 * | 4/2022 | Jen | F41A 19/11 |
| 2005/0183317 | A1 | 8/2005 | Finn | |
| 2011/0173859 | A1 | 7/2011 | Findlay | |
| 2013/0192116 | A1 | 8/2013 | Elftmann, Jr. | |
| 2014/0230297 | A1 | 8/2014 | Larson, Jr. et al. | |
| 2014/0331535 | A1 | 11/2014 | Robinson | |
| 2015/0354912 | A1 | 12/2015 | Miller, III | |
| 2016/0047614 | A1 | 2/2016 | Larson, Jr. | |
| 2016/0061548 | A1 | 3/2016 | Urias | |

(Continued)

*Primary Examiner* — Michelle Clement
(74) *Attorney, Agent, or Firm* — Fox Rothschild LLP

(57) ABSTRACT

Trigger guard assemblies for firearms include a trigger guard movable between a closed positon; and an open position providing greater access to a trigger bow of the firearm. The trigger guard assemblies also include a post that engages the trigger guard, and is movable in relation to the trigger guard between a retracted position and an extended position. When in the retracted position, the post does not interfere with movement of the trigger guard between the open and closed positions. When in the extended position, the post interferes with movement of the trigger guard between the open and closed positions, and exerts a lateral force on the firearm to further secure the trigger guard to the firearm.

12 Claims, 9 Drawing Sheets

(56) References Cited

U.S. PATENT DOCUMENTS

| | | | |
|---|---|---|---|
| 2016/0084599 | A1 | 3/2016 | Alicea, Jr. |
| 2016/0273857 | A1 | 9/2016 | Pettit |
| 2019/0162498 | A1 | 5/2019 | Amodio et al. |
| 2019/0331445 | A1 | 10/2019 | Full |

* cited by examiner

FIG. 8
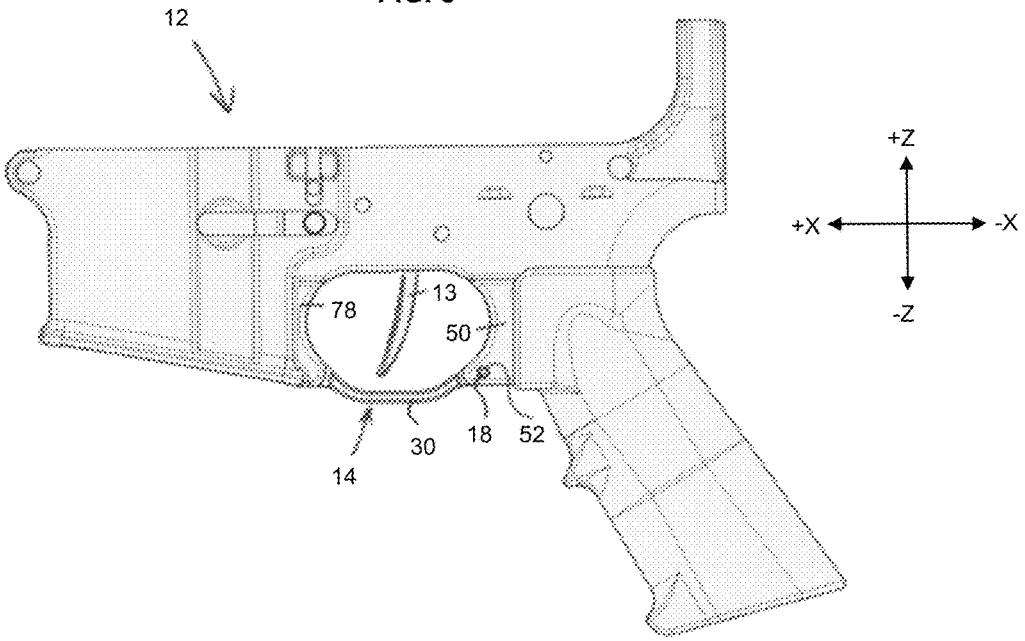
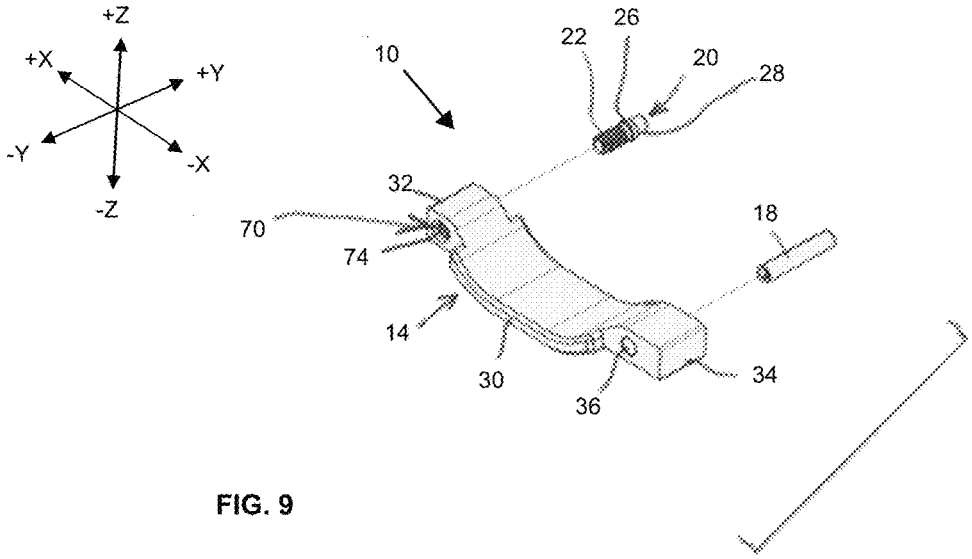
FIG. 9

TRIGGER GUARD ASSEMBLIES

CROSS-REFERENCE TO RELATED APPLICATIONS

This application is a continuation of U.S. patent application Ser. No. 16/362,277 filed Mar. 22, 2019, the disclosure of all of which are hereby incorporated by reference in its entirety.

BACKGROUND

Many firearms are equipped with a trigger guard to reduce the potential for accidental discharge. Trigger guards perform this function by limiting access to the trigger bow, which actuates the trigger mechanism of the firearm. The trigger guard may partially surround the trigger bow so as to prevent access from below, while still permitting the user to access and operate the trigger bow from the side.

However, a trigger guard may unduly restrict access to the trigger bow under certain circumstances. For example, the trigger guard may not leave sufficient room for the user to access the trigger bow when the user is wearing bulky gloves (e.g., during cold-weather conditions). Thus, some trigger guards are configured to be removed or rotated out of the way in order to provide unrestricted, or less restricted, access to the trigger bow.

For example, FIGS. 1-3 depict a removable prior art trigger guard 100 that is secured to the lower receiver 102 of a firearm by two set screws 104, which threadably engage respective forward and rearward end portions of the trigger guard 100. FIGS. 2 and 3 depict the set screw 104 associated with the forward end portion 106 of the trigger guard 100. The set screw 104 associated with the rearward end portion of the trigger guard 100 is substantially identical to the set screw 104 associated with the forward end portion 106 of the trigger guard 100.

As shown in FIGS. 2 and 3, forward end portion 106 is positioned between two forward flanges 107 of the lower receiver 102. The set screw 104 has external threads that engage internal threads within the forward end portion 106 of the trigger guard 100. The set screw 104 can be entirely retracted into the forward end portion 106, as shown in FIG. 2, so that the set screw 104 does not interfere with movement of the forward end portion 106 in relation to the forward flanges. Accordingly, the forward end portion 106 is removable from its position between the forward flanges 107 when the set screw 112 is in its retracted position. Alternatively, as shown in FIG. 3, the set screw 104 can be partially backed out of the trigger guard 100 so that an end portion 110 of the set screw 104 becomes disposed in a bore 112 formed in one of the forward flanges 107. Interference between the end portion 110 and the adjacent surface of the forward flange 107 restrains the forward end portion 106 of the trigger guard in relation to the forward flange 107, and thereby retains the trigger guard 100 on the lower receiver 102.

A significant disadvantage of this prior art design arises from the external threads on the set screw 104 being in contact with the adjacent surface of the forward flange 107. Over time, the force exerted by these threads on the forward flange 107 can cause premature wear and other types of damage to the forward flange 107, particularly because the forward flange is commonly formed from aluminum. Such damage can result in excessive movement and rattling of the trigger guard 100. Also, the external threads on the set screw 104 can make it difficult to achieve a minimal clearance between the set screw 104 and the adjacent surface of the forward flange 107, which can further contribute to rattling and excessive movement of the trigger guard 100. Moreover, the trigger guard 100 and the set screw 104 do not have a stop or other structure that causes the set screw 104 to restrain the trigger guard 100 laterally, and this lack of lateral restraint can further exacerbate rattling and excessive movement of the trigger guard 100.

In another example, FIGS. 4 and 5 depict a prior art trigger guard 120 in which a spring-biased plunger 122 is used in lieu of a set screw. Unlike the trigger guard 100, the trigger guard 120 can pivot from a closed positon (not shown) to an open positon (shown in FIG. 4), which provides greater access to the trigger bow 101*a*. A rearward end portion of the trigger guard 120 is coupled to rearward flanges 124 of a receiver 102*a* by a pin 126. This arrangement allows the trigger guard 120 to pivot in relation to the flanges 124.

The plunger 122 restrains the forward end portion 128 of the trigger guard 120 on a selective basis. As shown in FIG. 5, the plunger 122 is biased outwardly (in the "+y" direction) by a spring 125. This spring bias causes an end portion 129 of the plunger 122 to become positioned within a bore 130 formed in a forward flange 132 of the lower receiver 102*a* when the trigger guard 120 is in the closed positon. Interference between the end portion 129 of the plunger 122 and the adjacent surface of the forward flange 132 prevents the trigger guard 120 from rotating away from its closed position. The plunger 122 can be depressed inwardly, using a tool inserted through the bore 130, so that the trigger guard 120 can be moved from the closed to the open position. However, as shown in FIG. 5, the forward end portion 128 of the trigger guard 120 has a step 134 formed therein to retain the plunger 122. This results in a significant disadvantage of this prior art design because, due to the presence of the step 134, the plunger 122 does not exert any substantial lateral force on the forward flange 132. This lack of lateral restraint can result in rattling and excessive movement of the trigger guard 120. Also, because the plunger 122 needs to be depressed to allow movement of the trigger guard 120, excess clearance may be needed between the plunger 122 and the adjacent surface of the forward flange 132, which can further contribute to rattling and excessive movement of the trigger guard 100.

Thus, there is a need for an improved trigger guard that can be easily opened and closed without causing excess rattling and movement of the trigger guard.

SUMMARY

In one aspect, the disclosed technology relates to a trigger guard assembly for a firearm, including: a trigger guard having a body; a first end portion adjoining the body; and a second end portion adjoining the body and configured to be rotatably coupled to the firearm; and a post configured to threadably engage the first end portion of the trigger guard, and to move in relation to the first end portion of the trigger guard between a first position at which a substantial entirety of the post is positioned within the first end portion of the trigger guard, and a second positon at which an end portion of the post extends from the first end portion of the trigger guard; wherein the end portion of the post has a substantially smooth exterior surface and is configured to engage the firearm by way of the exterior surface when the post is in the second position. In one embodiment, the post further includes an intermediate portion adjoining the end portion of the post; and a body adjoining the intermediate portion and having external threads configured to engage the first end portion of the trigger guard. In another embodiment, the post is further configured to move from the first position to the second position in a first direction; and the intermediate portion is configured to engage the firearm and to exert a force on the firearm in the first direction when the post is in the second position. In another embodiment, a diameter of the intermediate portion is greater than a diameter of the end portion of the post. In another embodiment, the end portion of the post is further configured to engage the firearm by way of a bore in the firearm when the post is in the second position; and the diameter of the intermediate portion is greater than a diameter of the bore.

In another embodiment, the second end portion of the trigger guard is configured to be coupled for rotation to a receiver of the firearm so that the trigger guard can rotate between an open and a closed position in relation to the receiver; and the end portion of the post is configured to engage the receiver by way of the exterior surface of the end portion of the post when the post is in the second position and the trigger guard is in the closed position, and the engagement of the receiver and the exterior surface of the end portion of the post retains the trigger guard in the closed position. In another embodiment, the trigger guard assembly further includes a pin, wherein: the second end portion of the trigger guard has a bore formed therein and configured to receive the pin; and the pin is configured to rotatably couple the trigger guard to the firearm.

In another aspect, the disclosed technology relates to a firearm including a disclosed trigger guard assembly.

In another aspect, the disclosed technology relates to a trigger guard assembly for a firearm, including: a trigger guard having a body; a first end portion adjoining the body; and a second end portion adjoining the body and configured to be rotatably coupled to the firearm; and a post including an end portion, an intermediate portion adjoining the end portion, and a body adjoining the intermediate portion; wherein: the body of the post is configured to engage the first end portion of the trigger guard; the post is configured to move in a first direction in relation to the first end portion of the trigger guard, from a first position at which a substantial entirety of the post is positioned within the first end portion of the trigger guard, and a second positon at which the end portion of the post extends from the first end portion of the trigger guard; the end portion of the post is configured to engage the firearm when the post is in the second position; and the intermediate portion is configured to engage the firearm and to exert a force on the firearm in the first direction when the post is in the second position. In one embodiment, the end portion of the post has a substantially smooth exterior surface and is configured to engage the firearm by way of the exterior surface when the post is in the second position. In another embodiment, a diameter of the intermediate portion is greater than a diameter of the end portion of the post. In another embodiment, the end portion of the post is further configured to engage the firearm by way of a bore in the firearm when the post is in the second position; and the diameter of the intermediate portion is greater than a diameter of the bore.

In another embodiment, the second end portion of the trigger guard is configured to be coupled for rotation to a receiver of the firearm so that the trigger guard can rotate between an open and a closed position in relation to the receiver; and the end portion of the post is configured to engage the receiver when the post is in the second position and the trigger guard is in the closed position, and the engagement of the receiver and the exterior surface of the end portion of the post retains the trigger guard in the closed position. In another embodiment, the trigger guard assembly further includes a pin, wherein: the second end portion of the trigger guard has a bore formed therein and configured to receive the pin; and the pin is configured to rotatably couple the trigger guard to the firearm.

In another aspect, the disclosed technology relates to a trigger guard assembly for a firearm, including: a trigger guard configured to be coupled to a receiver of the firearm for rotation between an open positon at which a trigger bow of the firearm is accessible from below the firearm, and a closed positon at which the trigger guard blocks access to the trigger bow from below the firearm; and a post threadably engaging the trigger guard and having an end portion with a substantially smooth exterior surface, wherein: the post is configured to move in relation to the trigger guard between a first position at which a substantial entirety of the post is positioned within the trigger guard, and a second positon at which the end portion extends from the trigger guard; the exterior surface of the end portion of the post is configured to engage the receiver by way of the exterior surface when the post is in the second position and the trigger guard is in the closed position; and the engagement of the exterior surface of the end portion the post and the receiver retains the trigger guard in the closed position. In one embodiment, the post further includes an intermediate portion adjoining the end portion of the post, and a body adjoining the intermediate portion and having external threads configured to engage the trigger guard; the post is further configured to move from the first position to the second position in a first direction; and the intermediate portion is configured to engage the firearm and to exert a force on the firearm in the first direction when the post is in the second position. In another embodiment, a diameter of the intermediate portion is greater than a diameter of the end portion of the post. In another embodiment, the end portion of the post is further configured to engage the firearm by way of a bore in the firearm when the post is in the second position; and the diameter of the intermediate portion is greater than a diameter of the bore.

BRIEF DESCRIPTION OF THE DRAWINGS

The following drawings are illustrative of particular embodiments of the present disclosure and do not limit the scope of the present disclosure. The drawings are not to scale and are intended for use in conjunction with the explanations in the following detailed description. Various non-limiting embodiments will be described in detail with reference to the drawings, wherein like reference numerals represent like parts and assemblies throughout the several views.

FIG. 8 is a left side view of the lower receiver and trigger guard assembly shown in FIGS. 6 and 7, depicting the trigger guard assembly in the closed position.

FIG. 9 is an exploded perspective view of the trigger guard assembly shown in FIGS. 6-8.

DETAILED DESCRIPTION

Figure 1:
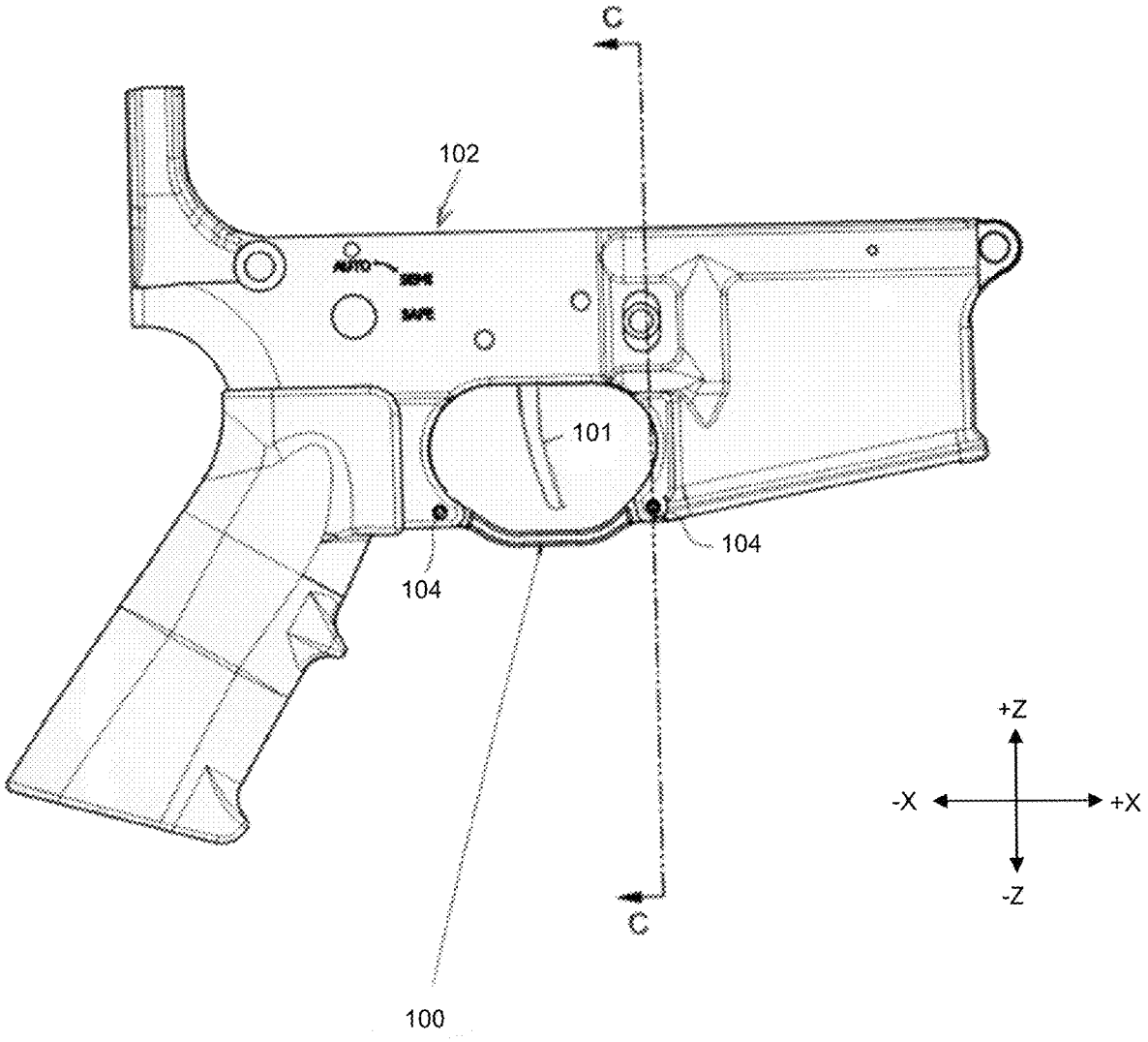
FIG. 1 PRIOR ART
FIG. 1 is a right side view of a lower receiver for a firearm, with a trigger guard assembly installed therein.
Figure 2:
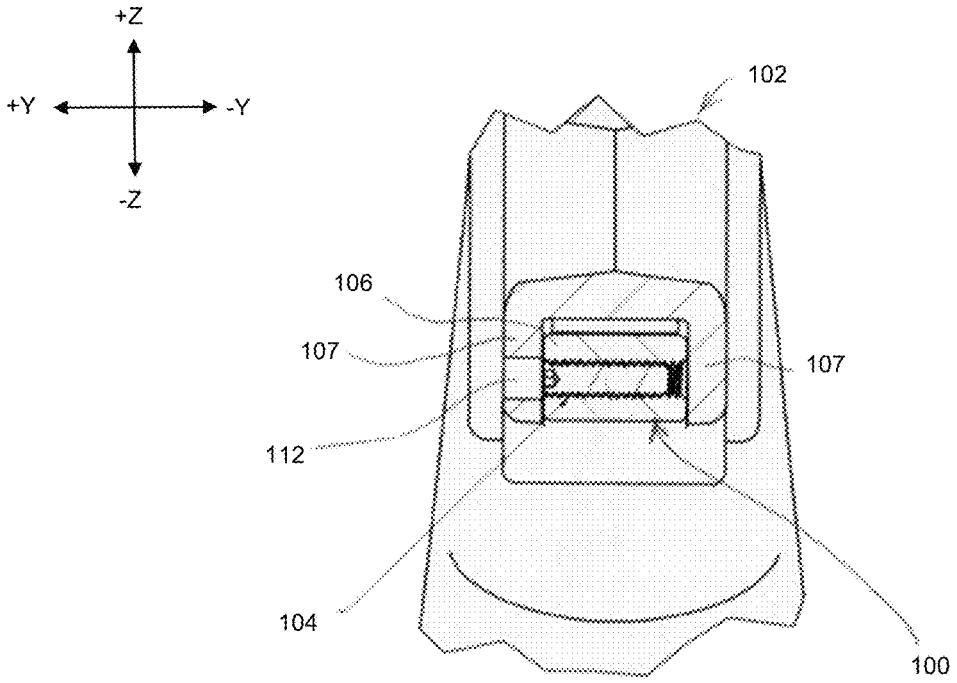
FIG. 2 PRIOR ART
FIG. 2 is a cross-sectional view of the lower receiver and trigger guard assembly shown in FIG. 1, taken through the line "C-C" of FIG. 1, depicting a set screw of the trigger guard assembly in a retracted position.
Figure 3:
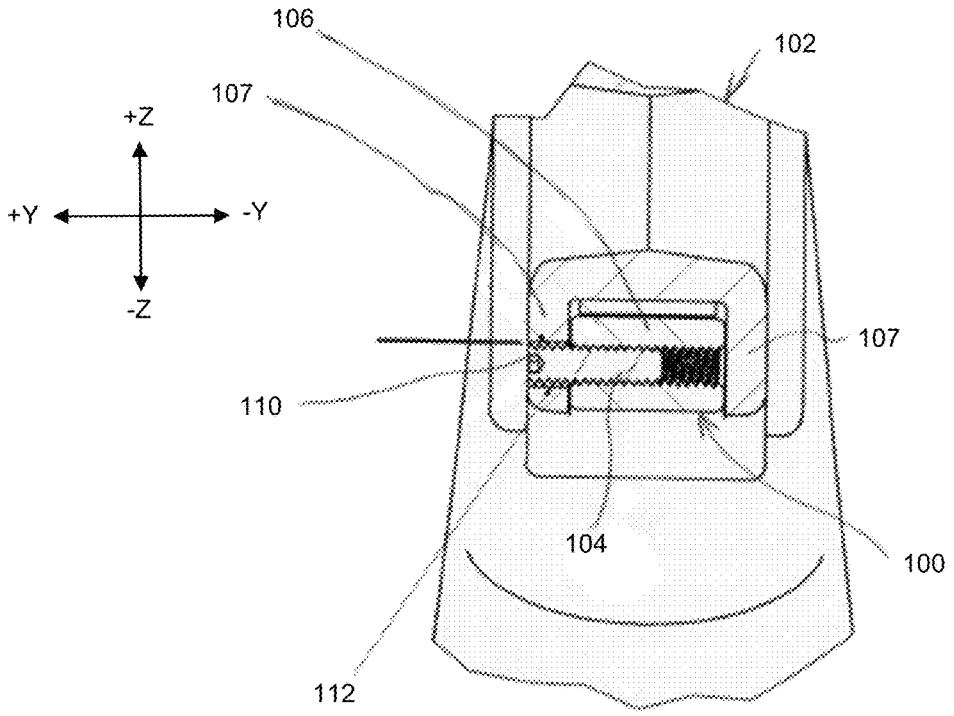
FIG. 3 PRIOR ART
FIG. 3 is a cross-sectional view of the lower receiver and trigger guard assembly shown in FIGS. 1 and 2, taken through the line "C-C" of FIG. 1, depicting the set screw in an extended position.
Figure 4:
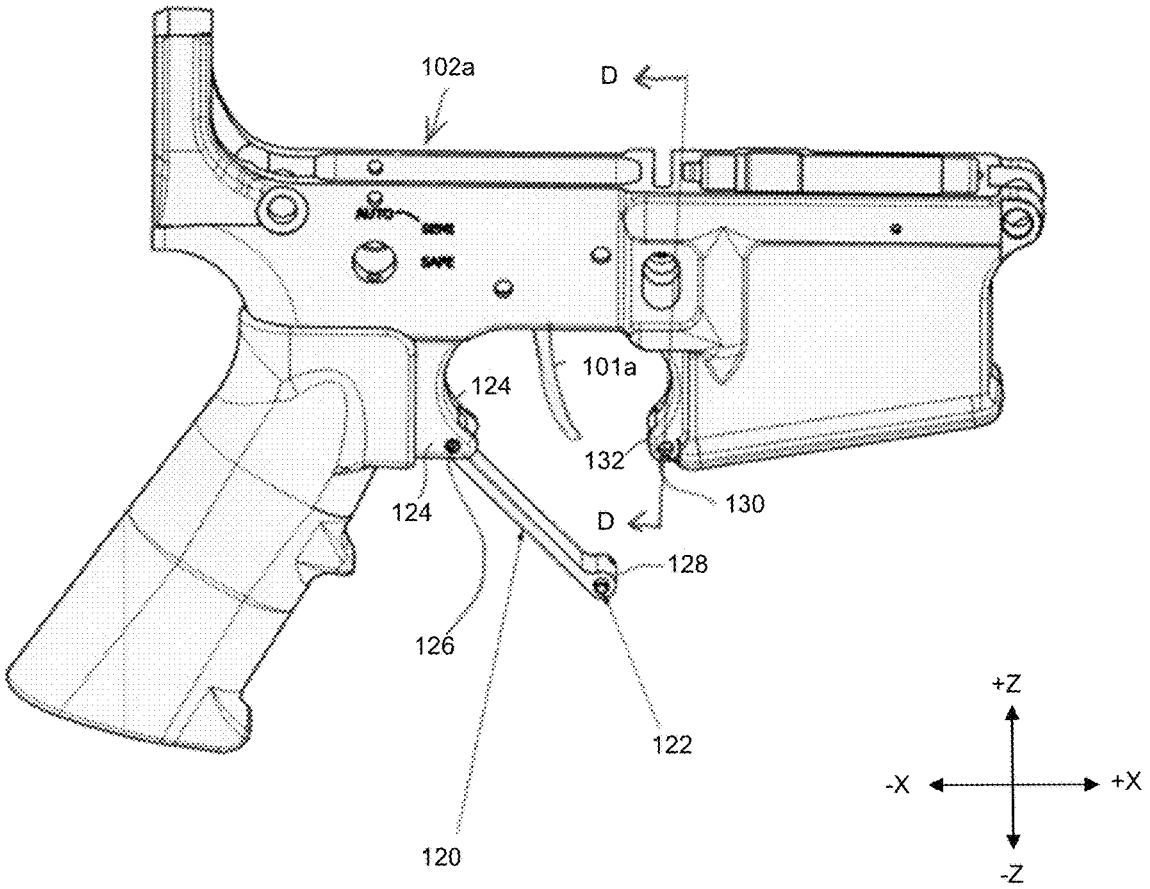
FIG. 4 PRIOR ART
FIG. 4 is a right side view of a lower receiver for a firearm, with another trigger guard assembly installed therein, and depicting the trigger guard assembly in an open position.
Figure 5:
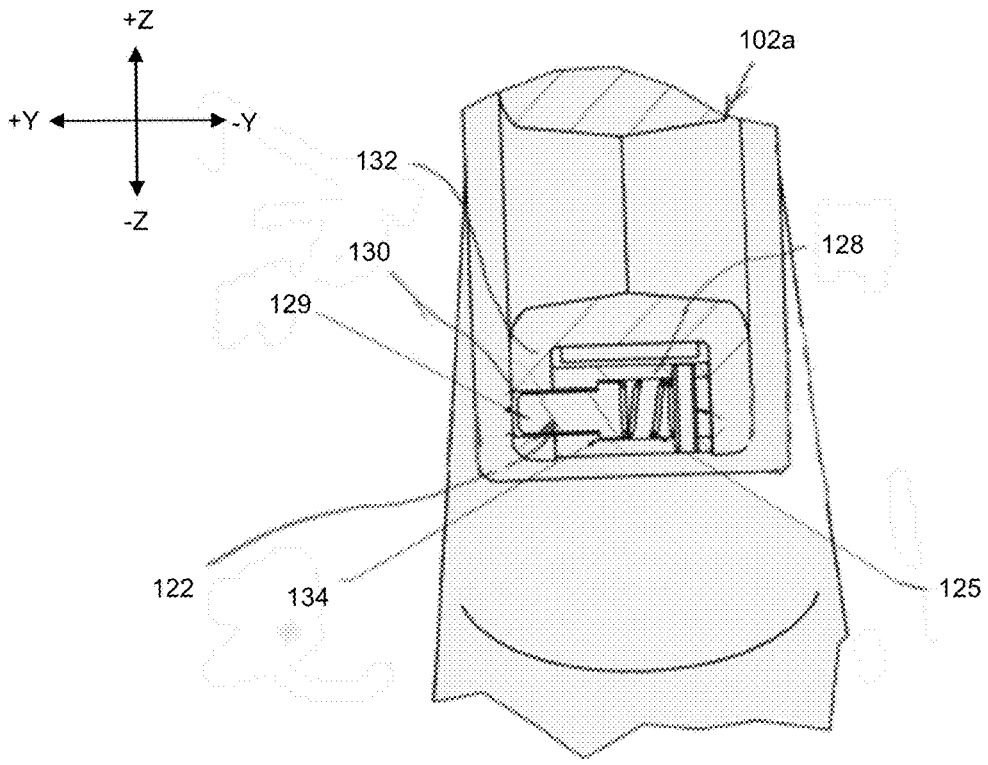
FIG. 5 PRIOR ART
FIG. 5 is a cross-sectional view of the lower receiver and trigger guard assembly shown in FIG. 4, taken through the line "D-D" of FIG. 4, depicting the trigger guard assembly in the open position.
Figure 6:
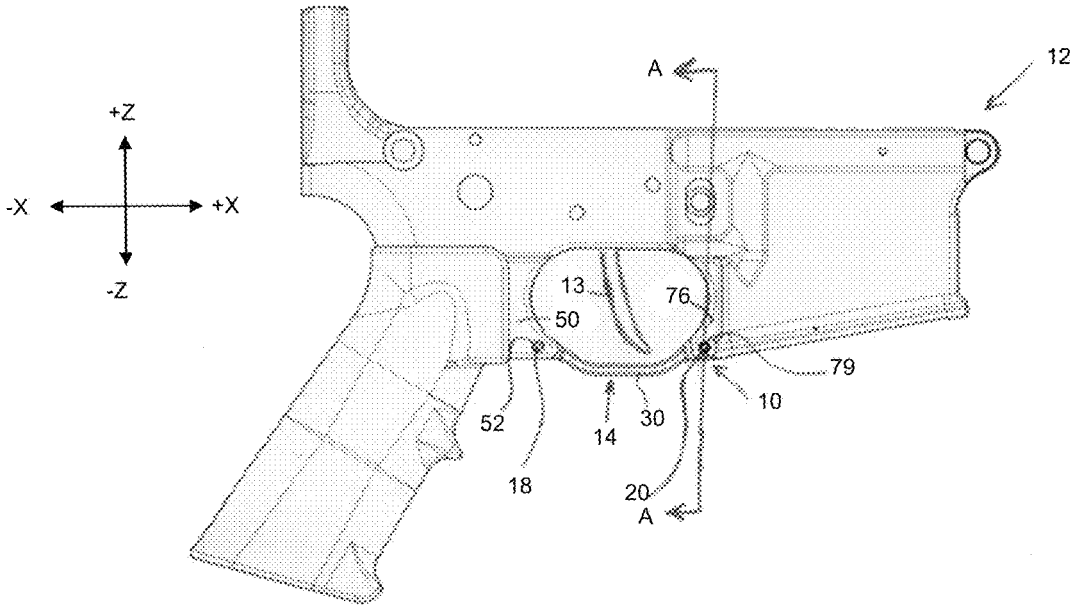
FIG. 6 is a right side view of a lower receiver for a firearm, with a pivoting a trigger guard assembly installed on the lower receiver, and depicting the trigger guard assembly in a closed position.
Figure 7:
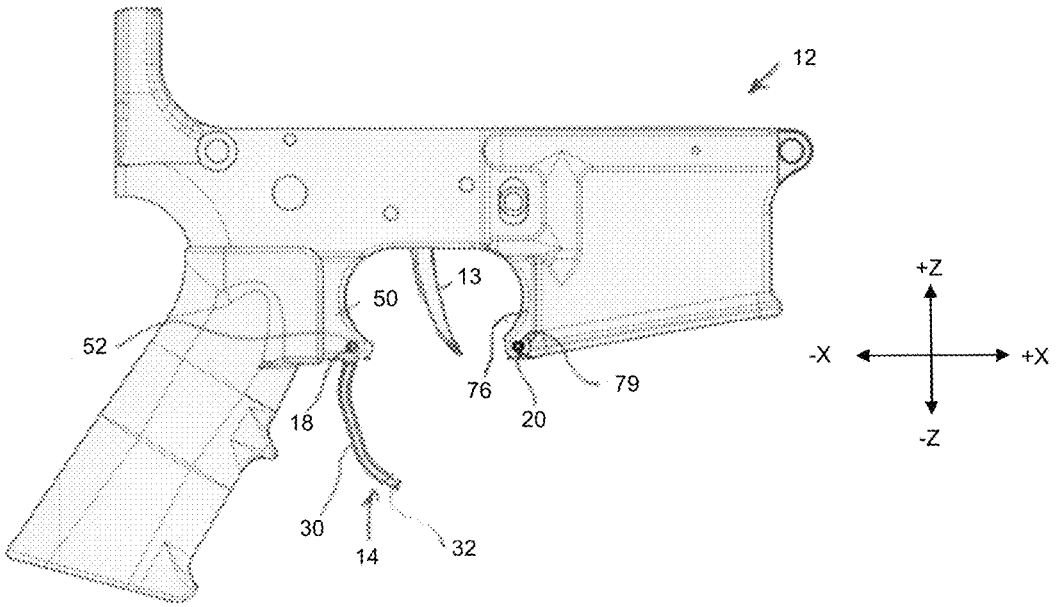
FIG. 7 is a right side view of the lower receiver and trigger guard assembly shown in FIG. 6, depicting the trigger guard assembly in an open position.

FIGS. 6-13 depict a trigger guard assembly 10 comprising a trigger guard 14, a post 16, and a pin 18. FIGS. 6-8 show the trigger guard assembly 10 mounted on a lower receiver 12 of an AR-15 semi-automatic rifle. This particular application is disclosed for exemplary purposes only. The trigger guard assembly 10 can be used on other types of semi-automatic rifles and other type of firearms including, for example, automatic rifles, shotguns, handguns, and the like.

The trigger guard 14 can be moved between a closed position shown in FIGS. 6, 8, and 11-13; and an open position shown in FIG. 7. When in the closed position, the trigger guard 14, along with the adjacent structure of the lower receiver 12, surround and partially restrict access to a trigger bow 13. The trigger bow 13 forms part of a trigger mechanism which, with the exception of the trigger bow 13, is positioned within the lower receiver 12. By partially restricting access to the trigger bow 13, the trigger guard 14 and the adjacent structure of the lower receiver 12 reduce the potential for an accidental discharge of the firearm.

The trigger bow 13 can be accessed from beneath when the trigger guard 14 is in the open position, as shown in FIG. 7. A firearm incorporating the trigger guard assembly 10 typically will be operated with the trigger guard 14 in the open position when the user is wearing bulky gloves during cold-weather operations, or under other conditions in which the trigger guard 14, in its closed position, would restrict the user from properly contacting the trigger bow 13.

Figure 10:
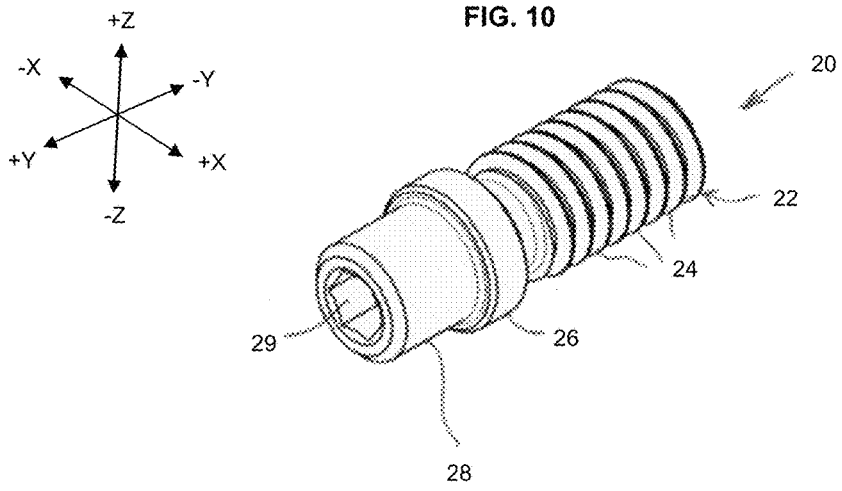
FIG. 10 is a perspective view of a post of the trigger guard assembly shown in FIGS. 6-9.

Referring to FIG. 10, the post 20 includes a cylindrical body 22 having external threads 24 formed thereon. The threads 24 are right-handed threads; left-handed threads can be used in the alternative. The post 20 also includes an intermediate portion 26. The intermediate portion 26 adjoins the body 22, and has a larger diameter than the body 22. The post 20 also has an end portion 28 that adjoins the intermediate portion 26. The end portion 28 has a smooth exterior, and a diameter that is smaller than that of the intermediate portion 26.

The body 22 can have a length ("y" dimension) of about 0.2 inch to about 0.4 inch (e.g., about 0.23 inch to about 0.3 inch), and a diameter of about 0.08 inch to about 0.2 inch (e.g., about 0.09 inch to about 0.15 inch). The intermediate portion 26 can have a length of about 0.02 inch to about 0.08 inch (e.g., about 0.03 inch to about 0.07 inch), and a diameter of about 0.08 inch to about 0.2 inch (e.g., about 0.13 inch to about 0.17 inch). The end portion 28 can have a length of about 0.07 inch to about 0.16 inch (e.g., about 0.08 inch to about 0.14 inch), and a diameter of about 0.09 inch to about 0.16 inch (e.g., about 0.11 inch to about 0.14 inch). These dimensions are presented for exemplary purposes only; the body 22, intermediate portion 26, and end portion 28 can have other dimensions in alternative embodiments.

A recess 29 is formed in the end portion 28, as shown in FIG. 10. The recess 29 is defined by a plurality of adjoining flat surfaces that together for a standard pattern for a hex key (not shown). The hex key is used to rotate the post 20 for the purposes discussed below. The end portion 28 of alternative embodiments can be configured to interface with other types of drivers in lieu of a hex key, such flat head screwdrivers, Phillips head screwdrivers, square head screwdrivers, TORX drivers, and the like.

The body 22, intermediate portion 26, and end portion 28 are unitarily formed. The body 22, intermediate portion 26, and end portion 28 can be formed separately, and can be joined by a suitable means such as welding in alternative embodiments.

Referring to FIG. 9, the trigger guard 14 has an elongated body 30, and a first end portion 32 that adjoins a first end of the body 30. The trigger guard 14 also includes a second end portion 34 that adjoins a second end of the body 30. The body 30 can have a substantially concave shape, as shown in FIGS. 6-9. The body 30 can have other shapes, including but not limited to a substantially straight shape, in alternative embodiments. The body 30, first end portion 32, and second end portion 34 are unitarily formed. The body 30, first end portion 32, and second end portion 34 can be formed separately, and can be joined by a suitable means such as welding in alternative embodiments.

The second end portion 34 has a smooth cylindrical bore 36 formed therein for receiving the pin 18. The bore 36 extends transverse to the lengthwise direction of the trigger guard 14—i.e., the bore 36 extends in the "y" direction. The bore 36 extends through the entire width ("y" dimension) of the second end portion 34. The diameter of the bore 36 is sized so that minimal clearance is about 0.0005 inch to about 0.006 inch (e.g., about 0.001 inch to about 0.004 inch), exists between the outer surface of the pin 18 and the adjacent surface of the second end portion 34 when the pin 18 is positioned within the bore 36.

The lower receiver 12 has two rear flanges 50 located behind the trigger bow 13. The rear flanges 50 face each other; and are spaced apart so that the second end portion 34 fits between the rear flanges 50 with minimal clearance—e.g., about 0.001 inch to about 0.02 inch (e.g., about 0.0005 inch to about 0.01 inch). Each flange 50 has a round hole 52 formed therein for receiving the pin 18. The trigger guard 14 can be pivotally coupled to the rear flanges 50 by inserting the second end portion 34 between the flanges 50, aligning the bore 36 in the second end portion 34 with the holes 52, and inserting the pin 18 through a first of the holes 52, the bore 36, and the other hole 52. The diameter of each hole 52 can be sized slightly smaller than the diameter of the pin 18, so that the ends of the pin 18 are retained in the holes 52 by an interference fit. Thus, the trigger guard 14 is coupled to and restrained by the lower receiver 12 by way of the rear flanges 50 and the pin 18; and can rotate about the pin 18 between its open and closed positions.

The post 20 selectively restrains the trigger guard 14 from rotating about the pin 18, to secure the trigger guard 14 in its closed position. In particular, the first end portion 32 of the trigger guard 14 has a cylindrical bore 70 formed therein for receiving the post 20. The bore 70 is depicted in FIGS. 9 and 11-13. The bore 70 extends transverse to the lengthwise direction of the trigger guard 14, i.e., the bore 70 extends in the "y" direction. The bore 70 has a first portion 72 and an adjoining second portion 74. The second portion 74 is threaded, with the threads configured to engage the external threads on the body 22 of the post 20. The first portion 72 is smooth; and has diameter slightly larger than the diameter of the intermediate portion 26 of the post 20. The different diameters of the first portion 72 and the smaller-diameter second portion 74 result in a step 75 between the first portion 72 and the second portion 74.

Figure 11:
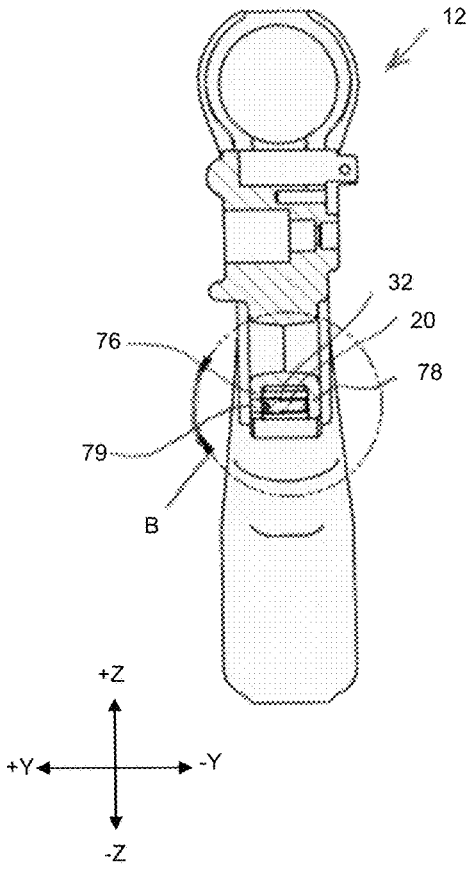
FIG. 11 is a cross-sectional view of the lower receiver and trigger guard assembly shown in FIGS. 6-10, taken through the line "A-A" of FIG. 6, depicting the trigger guard assembly in the closed position, and further depicting the post in a retracted position.
Figure 12:
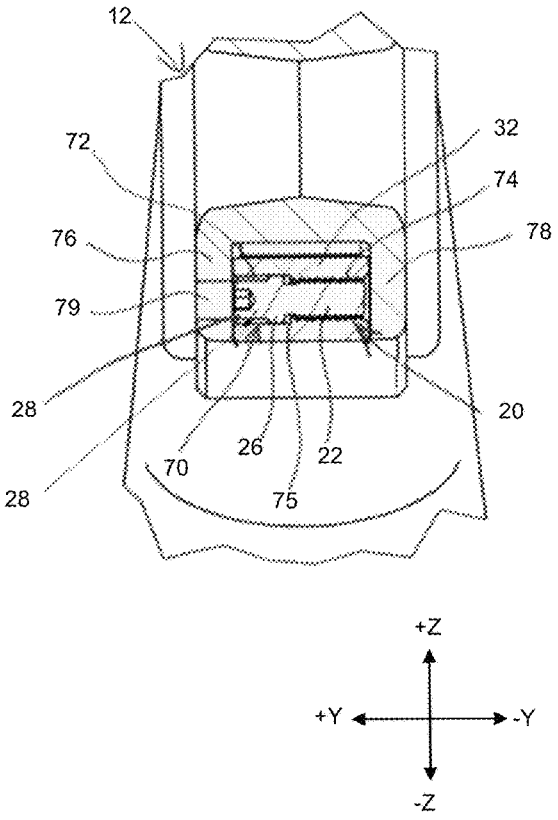
FIG. 12 is a magnified view of the area designated "B" in FIG. 11, depicting the trigger guard assembly in the closed position and the post in the retracted position.
Figure 13:
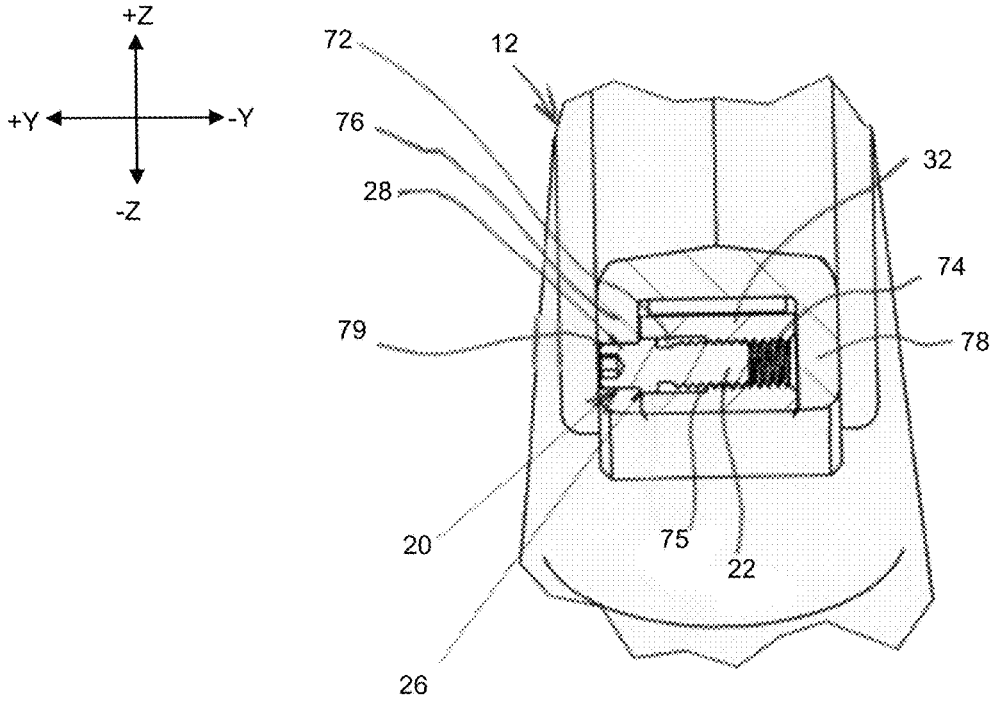
FIG. 13 is a magnified view of the area designated "B" in FIG. 11, depicting the trigger guard assembly in the closed position and the post in an extended position.

The post 20 can be positioned within the bore 70 in a first, or retracted position shown in FIGS. 11 and 12. When the post 20 is in the retracted position, the threads 24 on the body 22 of the post 20 fully engage the threads within the second portion 74 of the bore 70; the intermediate portion of the post 20 contacts, or is located proximate the step 75 between the first and second portions 70, 72; and the end portion 28 of the post 20 is located fully within the first portion 72 of the bore 70. As discussed below, the post 20 can be partially backed out of the bore 70 to a second, or extended position, shown in FIG. 13; and the end portion 28 of the post extends or projects from the first end portion 32 of the trigger guard 14 when the post 20 is in the extended position. The lower receiver 12 has a first forward flange 76 and a second forward flange 78, as shown in FIGS. 6-8 and 11-13. The first and second forward flanges 76, 78 are located forward of the trigger bow 13. The first and second forward flanges 76, 78 face each other, and are spaced apart so that the first end portion 32 of the trigger guard 14 fits between the first and second forward flanges 76, 78 with minimal clearance—e.g., about 0.001 inch to about 0.02 inch (e.g., about 0.0005 inch to about 0.01 inch). The first forward flange 76 has a smooth, circular bore 79 formed therein; the first and second forward flanges 76, 78 otherwise are substantially identical.

The bore 79 receives the end portion 28 of the post 20, as discussed below. The bore 79 has a diameter slightly greater than the diameter of the end portion 28, so that the end portion 28 can fit within the bore 79 with minimal clearance—e.g., about 0.001 inch to about 0.02 inch (e.g., about 0.0005 inch to about 0.01 inch) between the outer periphery of the end portion 29 and the adjacent surface of the first forward flange 76. The diameter of the bore 79 is less than the diameter of the intermediate portion 26; the significance of this feature is discussed below.

The first end portion 32 of the trigger guard 14 can be coupled to the first and second forward flanges 76, 78 by way of the post 20 when the trigger guard 14 is in its closed position, thereby securing the trigger guard 14 in the closed position. In particular, the trigger guard 14 is configured so that the bore 70 in the first end portion 32 aligns with the bore 79 in the first forward flange 76 when the trigger guard 14 is in its closed position. The trigger guard 14 can be rotated into its closed position while the post 20 is in its retracted position. The post 20 has an overall length, or "y" dimension, that is less than the overall length of the bore 70. This feature permits the entirely of the post 20 to fit within the bore 70 when the post 20 is fully retracted into the bore 58 as depicted in FIGS. 11 and 12. Thus, the post 20 does not interfere with rotation of the trigger guard 14 to its closed position when the post 20 is in its retracted position.

Once the trigger guard 14 has been rotated to its closed position and the bore 70 has thus been aligned with the bore 79, the post 20 can be partially backed out of the bore 70 to its extended position. The user can partially back the post 20 out of the bore 70 by inserting a hex key through the bore 79 so that the end of the hex key engages the hex pattern within the recess 29 of the end portion 28 of the post 20; and then rotating the key in a counter-clockwise direction from the perspective of FIG. 6. The resulting interaction between the right-handed threads 24 and the corresponding threads within the second portion 74 of the bore 70 causes the post 20 to move outward, in the "+y" direction, toward its extended position.

The end portion 28 of the post 20 enters the bore 79 as the post 20 moves toward its extended position. Because the diameter of the intermediate portion 26 of the post 20 is greater than the diameter of the hole 70, the outward movement of the post 20 eventually causes the intermediate portion 26 to contact the first forward flange 76. This contact occurs as the post 20 reaches the extended position, and prevents further outward movement of the post 20. The interaction between the intermediate portion 26 and the first forward flange 76 thus provides a positive stop to the outward movement of the post 20.

As noted above, the end portion 28 of the post 20 is sized to fit within the bore 79 with minimal clearance. The resulting interference between the outer peripheral surface of the end portion 28 and the adjacent surface of the first forward flange 76 restrains the post 20 from moving substantially in a plane extending in the "x" and "z" directions. Because the post 20 is rigidly connected to the first end portion 32 of the trigger guard 14 by way of the threaded connection between the post 20 and the first end portion 32, the restraint of the end portion 28 restrains the first end portion 32 in a corresponding manner, thereby preventing the trigger guard 14 from rotating on the pin 18. Also, the minimal clearance between the outer peripheral surface of the end portion 28 and the adjacent surface of the first forward flange 76; in conjunction with the solid contact between the intermediate portion 26 of the post 20 and the first forward flange 76, can minimize or eliminate rattling of the trigger guard 14 when the trigger guard 14 is in its closed position.

The trigger guard 14 can be moved to its open position by rotating the post 20 in a clockwise direction. The clockwise rotation of the post 20 causes the post 20 to be drawn inward, to its retracted position. Once the post 20 reaches the retracted position, the first forward flange 76 no longer interferes with movement of the end portion 28 in the "x-z" plane, and the trigger guard 14 is free to rotate on the pin 18, to its open position.

Thus, the trigger guard 14 can be opened and closed with a minimum of time and effort, without a need to remove any pins or screws, and without the use of any tooling other than a standard hex key. Also, the above-noted contact between the intermediate portion 36 of the post 20 and the first forward flange 76 helps to secure the post 20 from rotating out of its extended positon, which in turn secures the trigger guard 14 in its closed position. Moreover, because the contact between the post 20 and the lower receiver 12 occurs via two smooth surfaces, the initial clearance between the contacting surfaces can be relatively small; and the smooth contact interface can help minimize wear of the contacting surfaces over time.

As used herein, the term "about" in reference to a numerical value means plus or minus 10% of the numerical value of the number with which it is being used.

The various embodiments described above are provided by way of illustration only and should not be construed to limit the claims attached hereto. Those skilled in the art will readily recognize various modifications and changes that may be made without following the example embodiments and applications illustrated and described herein, and without departing from the true spirit and scope of the following claims.

I claim:

1. A trigger guard assembly for a firearm, comprising:

a trigger guard having a body; a first end portion adjacent the body; and a second end portion adjacent the body and configured to be rotatably coupled to the firearm; and a post comprising an end portion, a body, and an intermediate portion located between the end portion and the body and having a maximum diameter greater than a maximum diameter of the end portion of the post, wherein: the post is configured to move in relation to the first end portion of the trigger guard between a first position at which a substantial entirety of the post is positioned within the first end portion of the trigger guard, and a second position at which the end portion of the post extends from the first end portion of the trigger guard; the body has threads configured to engage the first end portion of the trigger guard; and the end portion of the post is configured to engage the firearm when the post is in the second position.

2. The trigger guard assembly of claim 1, wherein:

the post is further configured to move from the first position to the second position in a first direction; and the intermediate portion is configured to engage the firearm and to exert a force on the firearm in the first direction when the post is in the second position.

3. The trigger guard assembly of claim 1, wherein the end portion of the post is further configured to engage the firearm by way of a bore in the firearm when the post is in the second position; and the maximum diameter of the intermediate portion is greater than a diameter of the bore.

4. The trigger guard assembly of claim 1, wherein:

the second end portion of the trigger guard is configured to be coupled for rotation to a receiver of the firearm so that the trigger guard can rotate between an open and a closed position in relation to the receiver; and the end portion of the post is configured to engage the receiver by way of the exterior surface of the end portion of the post when the post is in the second position and the trigger guard is in the closed position, and the engagement of the receiver and the exterior surface of the end portion of the post retains the trigger guard in the closed position.

5. The trigger guard assembly of claim 1, further comprising a pin, wherein: the second end portion of the trigger guard has a bore formed therein and configured to receive the pin; and the pin is configured to rotatably couple the trigger guard to the firearm.

6. A firearm comprising the trigger guard assembly of claim 1.

7. A trigger guard assembly for a firearm, comprising:

a trigger guard having a body; a first end portion adjacent the body; and a second end portion adjacent the body and configured to be rotatably coupled to the firearm; and a post comprising an end portion, a body, and an intermediate portion located between the end portion and the body and having a maximum diameter greater than a maximum diameter of the end portion of the post and a maximum diameter of the body, wherein: the post is configured to move in relation to the first end portion of the trigger guard between a first position at which a substantial entirety of the post is positioned within the first end portion of the trigger guard, and a second position at which the end portion of the post extends from the first end portion of the trigger guard; the body is configured to configured to engage the first end portion of the trigger guard; and the end portion of the post is configured to engage the firearm when the post is in the second position.

8. The trigger guard assembly of claim 7, wherein:

the post is further configured to move from the first position to the second position in a first direction; and the intermediate portion is configured to engage the firearm and to exert a force on the firearm in the first direction when the post is in the second position.

9. The trigger guard assembly of claim 7, wherein the end portion of the post is further configured to engage the firearm by way of a bore in the firearm when the post is in the second position; and the maximum diameter of the intermediate portion is greater than a diameter of the bore.

10. The trigger guard assembly of claim 7, wherein:

the second end portion of the trigger guard is configured to be coupled for rotation to a receiver of the firearm so that the trigger guard can rotate between an open and a closed position in relation to the receiver; and the end portion of the post is configured to engage the receiver by way of the exterior surface of the end portion of the post when the post is in the second position and the trigger guard is in the closed position, and the engagement of the receiver and the exterior surface of the end portion of the post retains the trigger guard in the closed position.

11. The trigger guard assembly of claim 7, further comprising a pin, wherein: the second end portion of the trigger guard has a bore formed therein and configured to receive the pin; and the pin is configured to rotatably couple the trigger guard to the firearm.

12. A firearm comprising the trigger guard assembly of claim 7.

* * * * *